US006186519B1

(12) United States Patent
Gorza

(10) Patent No.: US 6,186,519 B1
(45) Date of Patent: Feb. 13, 2001

(54) DEVICE FOR CONNECTING A SHOE TO A SPORTS IMPLEMENT

(75) Inventor: Roberto Gorza, Feltre (IT)

(73) Assignee: Benetton Sportsystem S.p.A., Trevignano (IT)

( * ) Notice: Under 35 U.S.C. 154(b), the term of this patent shall be extended for 0 days.

(21) Appl. No.: 09/151,585

(22) Filed: Sep. 11, 1998

(30) Foreign Application Priority Data

Sep. 25, 1997 (IT) ..... TV97A0131

(51) Int. Cl.[7] ..... A63C 1/04

(52) U.S. Cl. ..... 280/11.31; 280/11.33; 280/625

(58) Field of Search ..... 280/11.31, 11.33, 280/625, 617, 11.221, 626, 623, 11.231, 11.3

(56) References Cited

U.S. PATENT DOCUMENTS

| | | | | |
|---|---|---|---|---|
| 3,909,026 | * | 9/1975 | Salomon | 280/11.22 |
| 3,910,591 | * | 10/1975 | Salomon | 280/11.22 |
| 3,963,253 | * | 6/1976 | Rieger | 280/617 X |
| 4,298,209 | * | 11/1981 | Peters | 280/11.31 X |
| 5,566,966 | * | 10/1996 | Couderc et al. | 280/617 X |
| 5,813,688 | * | 9/1998 | Dacklin | 280/14.2 X |
| 5,855,380 | * | 1/1999 | DeFilippo | 280/11.31 X |

FOREIGN PATENT DOCUMENTS

| | | | | |
|---|---|---|---|---|
| 2322154 | | 11/1973 | (DE) . | |
| 4018276 | * | 9/1991 | (DE) | 280/14.2 |
| 4106401A1 | * | 9/1992 | (DE) | 280/14.2 |
| 0039489 | | 11/1981 | (EP) . | |
| 2621254 | * | 4/1989 | (FR) | 280/14.2 |
| 2624389 | | 6/1989 | (FR) . | |
| 2626189 | | 7/1989 | (FR) . | |
| 2652753 | * | 4/1991 | (FR) | 280/14.2 |
| WO 90/11805 | * | 10/1990 | (WO) | 280/14.2 |
| WO94/25125 | * | 11/1994 | (WO) | 280/14.2 |
| WO96/22136 | * | 6/1996 | (WO) | 280/617 X |

* cited by examiner

*Primary Examiner*—Lanna Mai
(74) *Attorney, Agent, or Firm*—Guido Modiano; Albert Josif; Daniel O'Byrne

(57) ABSTRACT

A device for coupling a shoe to a sports implement, such as a skate frame, includes a first abutment and retention front element for containing the longitudinal, lateral and perpendicular movements of the shoe with respect to the frame, and a second self-fastening rear element which is also articulated to the frame.

10 Claims, 3 Drawing Sheets

DEVICE FOR CONNECTING A SHOE TO A SPORTS IMPLEMENT

BACKGROUND OF THE INVENTION

The present invention relates to a device for connecting a shoe to a sports implement, such as a skate frame with wheels which are arranged mutually in-line or otherwise.

Currently, conventional skate comprise a shoe, formed for example by injecting plastics so as to form a shell whereto a quarter is articulated. A frame, usually also made of plastics, is associated at the sole of said shell and has a U-shaped cross-section between the wings of which two or more in-line wheels are pivoted.

This construction has the severe limitation that it can be used only for skating, accordingly forcing the user to remove, before wearing the skates, the shoes that he usually wears for normal walking.

Swiss Patent No. 602147 discloses a skate with in-line wheels composed of a shoe which can be detached from a frame. The frame has a fixed abutment which protrudes at one of its ends, has an arched shape and interacts with the tip of the shoe, so as to allow optimum centering thereof and prevent it from lifting.

The ends of a traction element are associated at the opposite end, laterally to the frame. The traction element surrounds the rear of the heel of the shoe and has a tensioning lever which interacts with the upper edge of the heel and the free end whereof is associated with the shoe by means of an adapted band that surrounds it.

In this construction, both the forward abutment and the rear traction element require adapted seats provided on the shoe approximately at the sole. The lever is also provided with a strap which prevents accidental disengagement of said lever by surrounding the ankle and therefore must be fastened and unfastened by the user. This is not always easy, since these operations are performed while crouching.

Moreover, locking the shoe requires operations which, if they are not performed with the necessary attention, can cause sudden disengagements of the frame and of the shoe, with consequent injury to the user.

A skate with in-line wheels is also known which is marketed by the Italian company MGM under the trade-name HYPNO. Such skate is provided with a shoe which can be detached from a frame supporting a plurality of mutually in-line wheels.

At the frame there is provided an engagement element, such as a pivot, for a grip element constituted by a blade arranged below the sole of the shoe. The shoe is locked with respect to the frame by means of an H-shaped rod provided at the rear of said frame. The ends of the H-shaped rod are pivoted to the frame at one end and pivoted, at the other end, to a lever which interacts with an adapted element associated with the shoe.

Although this conventional skate partially solves the above-mentioned drawbacks, it is complicated from the structural and constructive point of view, and it is also complicated for the user to mutually connect the frame and the shoe.

The conventional skate is also expensive because of the large number of component parts used both in the shoe and in the frame in order to achieve mutual coupling.

Moreover, the complexity of the above-described skate is due to the many parts employed and to the many work steps required for the production and complete assembly of the skate; all this accordingly entails a high final weight and cost, while the kind of walk allowed when the shoe is not coupled to the skate is awkward because of the weight and rigidity of the sole.

SUMMARY OF THE INVENTION

An aim of the present invention is to solve the above-described problems, eliminating the drawbacks of the prior art by providing a device for coupling a shoe to a sports implement, such as a snowboard or a frame of a skate with wheels arranged in-line or otherwise, which is structurally simple and effective.

An important object of the present invention is to provide a device which allows to optimally fasten the shoe.

Another important object of the present invention is to provide a device which allows the user to fasten the shoe quickly and simply.

Another important object is to provide a device which allows reliable shoe fastening.

Another object is to provide a device which prevents any human error in shoe fastening.

Another object is to provide a device which is compact.

Another object is to provide a device which is reliable and safe in use and can be manufactured with conventional and known machines and equipment.

This aim, these objects and others which will become apparent hereinafter are achieved by a device for coupling a shoe to a sports implement, such as a snowboard or a skate having a frame, characterized in that it comprises by at least one first front element, which is fixed to said frame, and by a second self-fastening rear abutment and retention element which is articulated to said frame to contain longitudinal, lateral and perpendicular movements of said shoe with respect to said frame.

BRIEF DESCRIPTION OF THE DRAWINGS

Further characteristics and advantages of the present invention will become apparent from the following detailed description of a particular but not exclusive embodiment, illustrated only by way of non-limitative example in the accompanying drawings, wherein.

DESCRIPTION OF THE PREFERRED EMBODIMENTS

Figure 1:
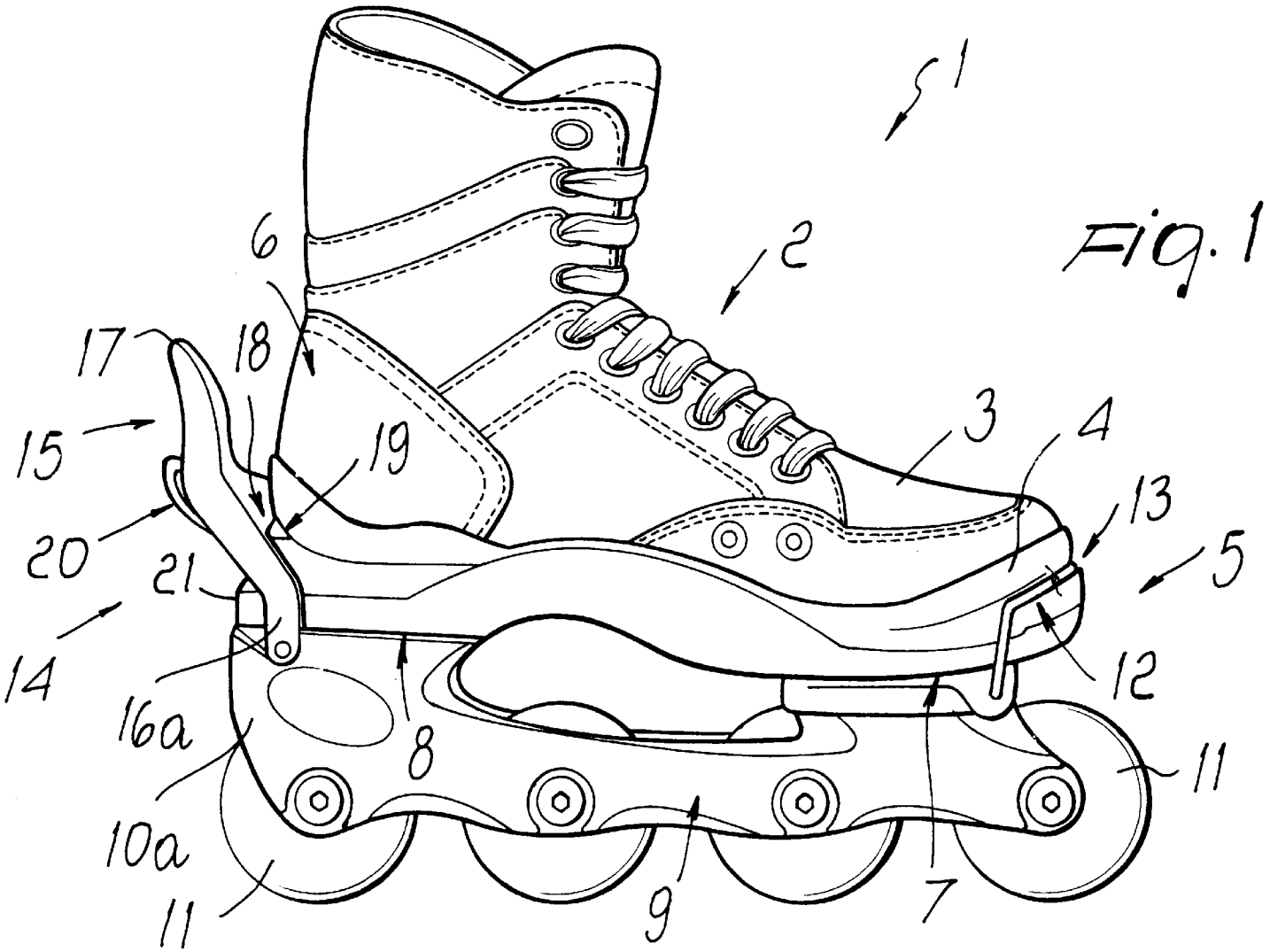
FIG. 1 is a side view of the device applied to a sports implement constituted by a skate according to the present invention.
Figure 2:
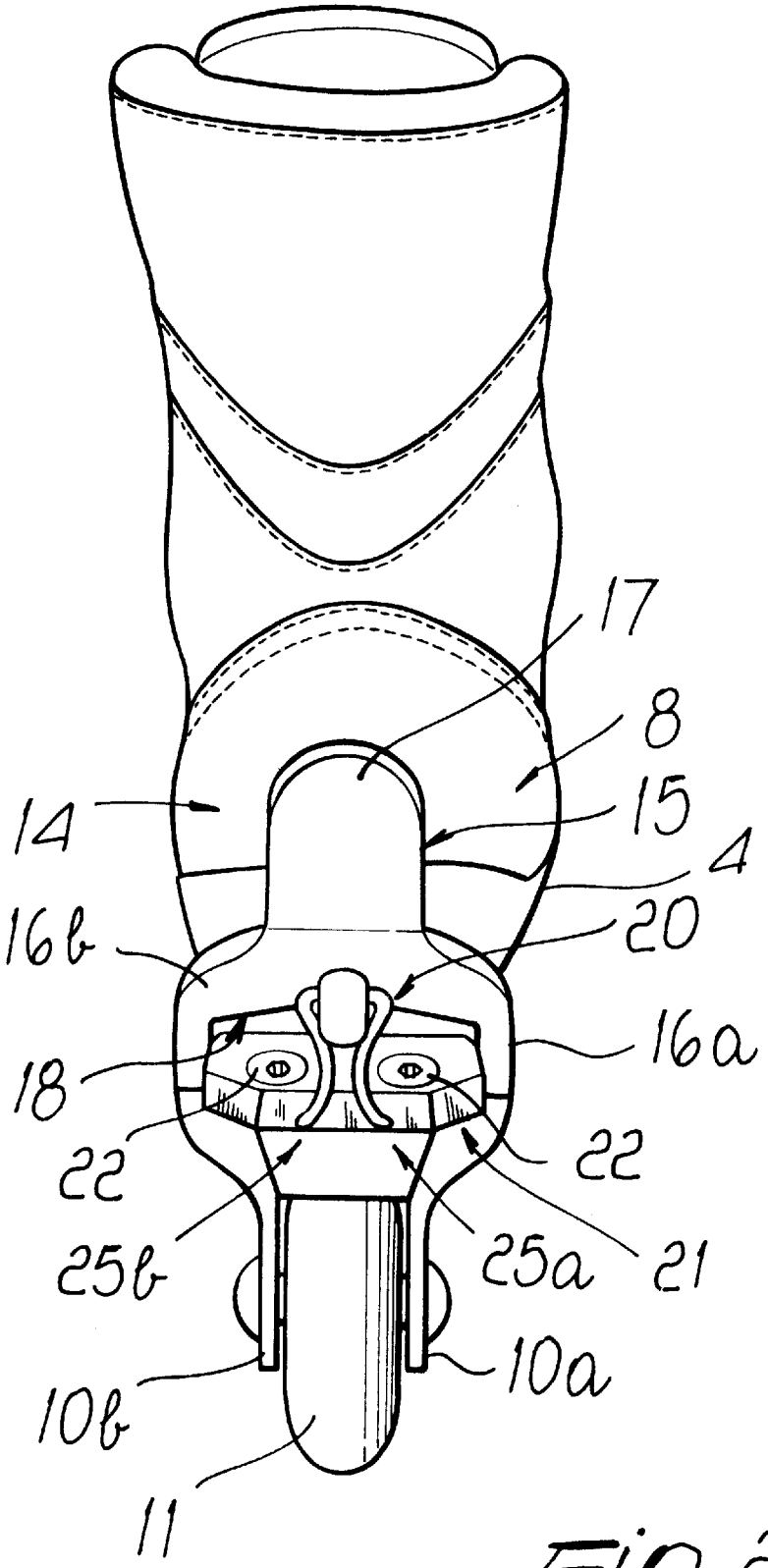
FIG. 2 is a rear view of the skate of FIG. 1.
Figure 3:
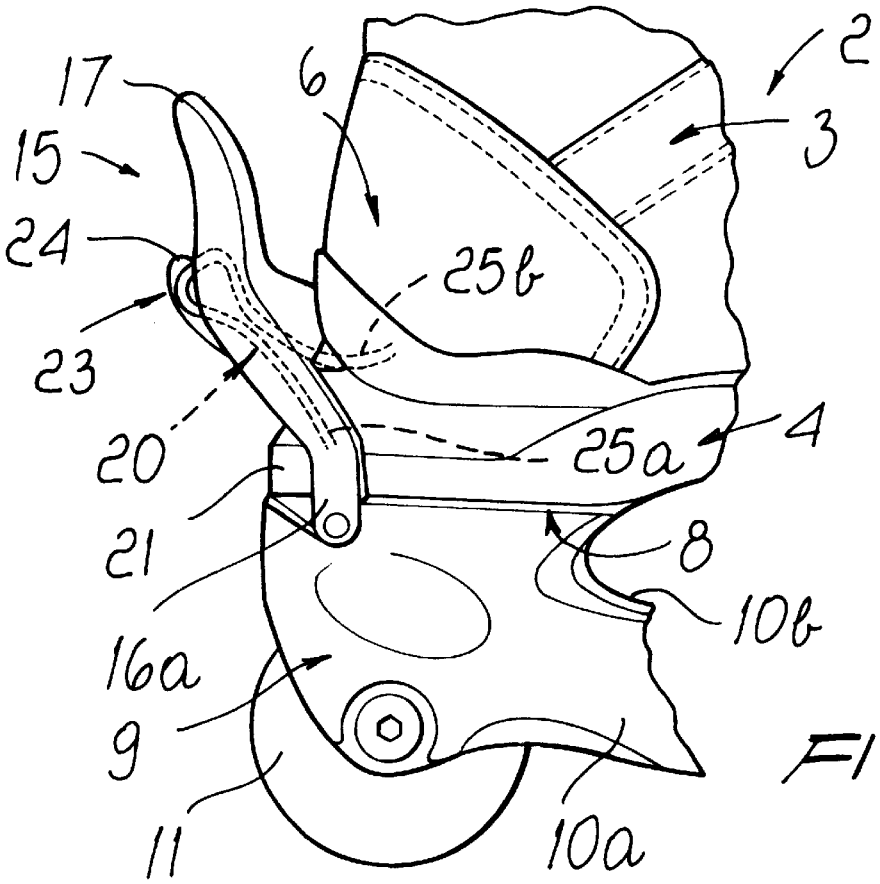
FIG. 3 is a view of a detail of the device.
Figure 4:
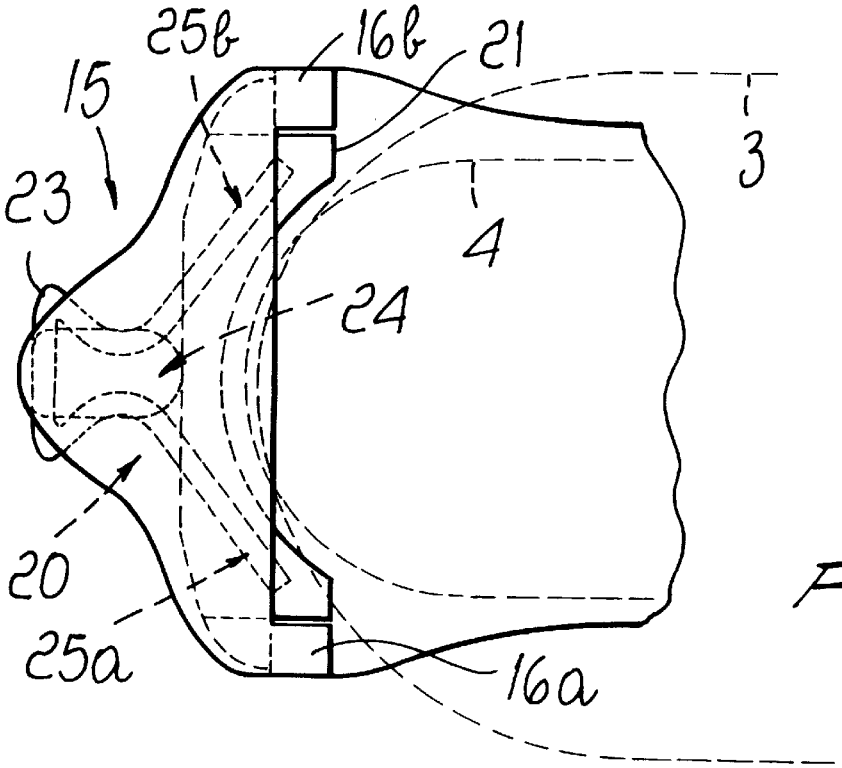
FIG. 4 is a schematic plan view of the device, according to the present invention, in the heel region.

With reference to the above figures, the reference numeral 1 designates a sports implement constituted by a skate composed of a shoe 2 which comprises an upper 3, preferably of the soft type, below which a sole 4 is associated.

Said sole rests, below the tip region 5 and the heel region 6, at a first base 7 and at a second base 8 of a frame 9 which forms a pair of wings 10*a*, 10*b* between which two or more wheels 11 are freely pivoted and are thus mutually in-line.

The device for coupling the shoe to the skate is composed of a first front abutment and retention element 12 for the region of the tip 5. Said element is constituted by a fixed ring which is associated with the first base 7 and protrudes laterally and upwards therefrom; said first element can be arranged at a complementarily shaped first seat 13 formed on the sole 4 of the shoe 2.

The first front element 12 thus has an advantageously arched shape, so as to follow the shape of the tip of the shoe, and acts as an abutment and retention element for containing longitudinal, lateral and perpendicular movements of the shoe with respect to the first base 7 of the frame 9.

Moreover, the coupling device is constituted by a second self-fastening rear element 14 which is constituted by a lever 15 which is substantially shaped like an inverted letter Y and wherein the two facing free ends 16*a,* 16*b* are rotatably articulated at the second base 8 of the frame 9, while the stem 17 is directed away from said frame 9.

The connecting region between said two facing free ends and the stem form a third base 18 which interacts, when the lever 15 is turned clockwise, so as to abut against a second seat 19 which is step-shaped and formed at the rear region of the sole 4.

The lever 15 thus constitutes an abutment and retention element for containing longitudinal, lateral and perpendicular movements of the shoe with respect to the second base 8 of the frame 9.

In order to provide lever self-fastening, the second rear element 14 is also constituted by a spring or torsion bar 20 which interacts between said lever 15 and an adapted plate 21 locked to the underlying frame 9 for example through adapted screws 22.

The spring or torsion bar 20 is preferably approximately omega-shaped, accordingly forming an annular portion 23 which is coupled to the stem 17 of the lever 15 at an adapted tab 24 which protrudes rearwards from said stem.

The free ends 25*a,* 25*b* of the spring or torsion bar 20 instead advantageously diverge and are then locked below the plate 21.

This configuration of the spring or torsion bar and the position of its portion 23 and of its free ends 25*a,* 25*b* allow the spring or torsion bar to undergo both flexural and torsional deformation when the lever 15 is turned counterclockwise.

Said particular configuration allows to provide the self-fastening characteristic for the second rear element, since the user merely has to insert the tip at the first front element 12 and then, while supporting the frame 9, press with the heel of the shoe at the second rear element 14 in order to make the lever 15 rotate slightly counterclockwise; said lever is then forced, by the spring or torsion bar 20, clockwise against the shoe until the third base 18 is arranged at the second seat 19, thus locking the shoe.

It has thus been observed that the present invention has achieved the intended aim and objects, a device for coupling a shoe to a sports implement, such as a skate frame, having been disclosed which is structurally simple and effective in achieving, quickly and very easily for the user, optimum and reliable fastening of the shoe by means of the considerable thrust imparted to the lever by the spring 20.

Moreover, said fastening is achieved in a straightforward manner and without requiring the user to perform appropriate specific maneuvers, thus also eliminating any human error in achieving said fastening.

The device is also compact by virtue of the configuration of the spring or torsion bar 20, which is capable of providing an intense elastic force obtainable only with much larger conventional springs.

The device according to the invention is of course susceptible of numerous modifications and variations, all of which are within the scope of the same inventive concept.

The materials and the dimensions that constitute the individual components of the structure may of course be the most pertinent according to specific requirements.

The disclosures in Italian Patent Application No. TV97A000131 from which this application claims priority are incorporated herein by reference.

What is claimed is:

1. A device for removably coupling a shoe to a frame of sports implement, said device comprising:

at least one first front abutment and retention element, which is fixed to said frame, and which is configured for engaging a front seat formed at a tip region of said shoe for containing longitudinal, lateral and perpendicular movements of said tip region with respect to said frame;

a second self-fastening rear abutment and retention element comprising a lever which is articulated to said frame and which is configured for engaging a rear seat formed at a heel region of said shoe for containing longitudinal, lateral and perpendicular movements of said heel region with respect to said frame, said second self-fastening rear abutment and retention element further comprising a spring element which is connected between said frame and said lever for biasing said lever forwardly towards said first front abutment and retention element, and said first and second abutment and retention elements being mutually configured such that, upon engagement of said first front abutment and retention element with said front sear of said tip region of said shoe and upon pressing of said heel region of said shoe at said second self-fastening rear abutment and retention element, said lever pivots initially rearwardly away from said first front abutment and retention element until said lever pivots subsequently back towards said first front abutment and retention element and engages with said rear seat of said heel region of said shoe for providing an automatic self-fastening of said rear abutment and retention element.

2. The device according to claim 1, said frame having a first base and a second base, said first front element being constituted by a ring which is associated with said first base and protruding laterally and upwards therefrom for engaging said first seat shaped complementarily to said ring and formed on the tip region of a sole of said shoe.

3. The device according to claim 2, wherein said ring has an arched shape so as to match the shape of the tip region of said sole of said shoe.

4. The device according to claim 3, said lever being substantially shaped like an inverted letter Y and having two facing free ends which are rotatably articulated to said second base of said frame and having a stem directed away from said frame.

5. The device according to claim 4, comprising a region that connect said two facing free ends and said stem of said lever which forms a third base for engaging by abutment with said rear seat which is formed at the heel region of said sole of said shoe and which has a step shape.

6. The device according to claim 5, wherein said spring element is connected to a plate locked to said frame.

7. The device according to claim 6, wherein said spring element is a torsion bar.

8. The device according to claim 6, wherein said spring element is approximately omega-shaped, so as to form an annular portion which is coupled at a tab which protrudes rearwards from said stem of said lever.

9. The device according to claim 8, wherein free ends of said spring element diverge and are locked below said plate.

10. The device according to claim 9, wherein said spring element is adapted to undergo both flexural and torsional deformation when said lever pivots initially rearwardly away from said first front abutment and retention element.

* * * * *